United States Patent [19]

Schlütter et al.

[11] Patent Number: 4,900,195

[45] Date of Patent: Feb. 13, 1990

[54] METHOD AND APPARATUS FOR USE IN A SLURRY FILLED TRENCH FOR PROVIDING A SEALING SHIELD THEREIN

[75] Inventors: Aloys Schlütter, Kempen; Klaus Kaewert, Düsseldorf; Christian Witolla, Duisburg; Bernd Kopp, Wachtendonk; Hans-Jürgen Rösler, Kerken, all of Fed. Rep. of Germany

[73] Assignee: Niederberg-Chemie GmbH, Neukirchen-Vluyn, Fed. Rep. of Germany

[21] Appl. No.: 201,493

[22] Filed: May 31, 1988

[30] Foreign Application Priority Data

May 29, 1987 [DE] Fed. Rep. of Germany ..... 3717999
Jun. 23, 1987 [DE] Fed. Rep. of Germany ..... 3720670

[51] Int. Cl.[4] ..... E02D 5/20

[52] U.S. Cl. ..... 405/267; 405/266; 405/270; 405/258

[58] Field of Search ..... 405/266, 267, 268, 270, 405/258

[56] References Cited

U.S. PATENT DOCUMENTS

| | | | |
|---|---|---|---|
| 4,100,391 | 7/1978 | Wilbur | 219/81 |
| 4,211,118 | 7/1980 | Sakurai et al. | 73/592 |
| 4,484,835 | 11/1984 | van Klinken | 405/270 X |
| 4,519,729 | 5/1985 | Clarke, Jr. et al. | 405/267 X |
| 4,531,413 | 7/1985 | Tsuchita et al. | 73/637 |
| 4,664,560 | 5/1987 | Cortlever | 405/267 X |
| 4,679,965 | 7/1987 | Gläser et al. | 405/258 |
| 4,696,607 | 9/1987 | Ressi di Cervia | 405/179 X |

*Primary Examiner*—Dennis L. Taylor
*Assistant Examiner*—J. Russell McBee
*Attorney, Agent, or Firm*—Nils H. Ljungman

[57] ABSTRACT

According to the invention, to connect sealing strips overlapping one another which are located in a trench in the ground. A housing is placed at the overlap region which spans this region and seals the region. Next the housing is pumped empty of a filling agent, such as bentonite which is used to stabilize the trench. The overlap region is then cleaned for welding, and can then be welded by means of commercially available welding equipment.

37 Claims, 14 Drawing Sheets

FIG. 20
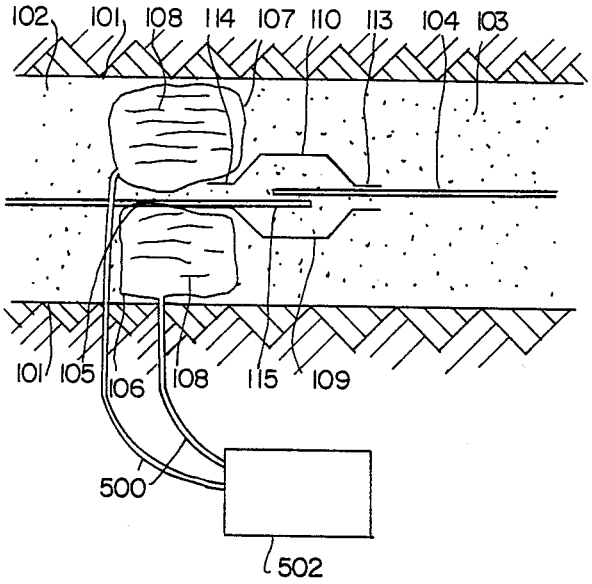
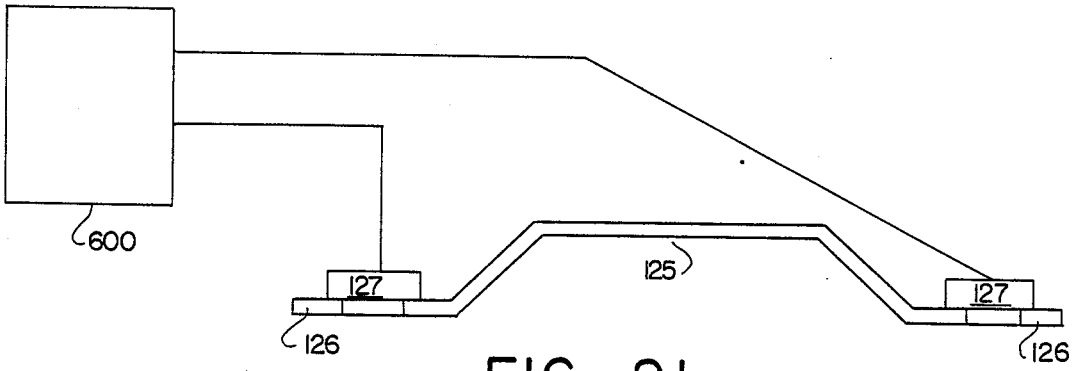
FIG. 21

METHOD AND APPARATUS FOR USE IN A SLURRY FILLED TRENCH FOR PROVIDING A SEALING SHIELD THEREIN

BACKGROUND OF THE INVENTION

1. Field of the Invention

This invention relates to a process for inserting sealing strips in subterranean an curtains or barriers between the walls of underground trenches which trenches are packed with bentonite or similar packings.

2. Description of the Prior Art

Subterranean an curtains are of great importance for the sealing of receptacles or terrain carrying or holding water or the sealing of water-bearing strata. Subterranean curtains are constructed by excavating trenches, and simultaneously filling them with support compounds such as bentonite. A solidifier, e.g. cement, can also be added to the bentonite. Such subterranean curtains offer a certain degree of sealing. For requirements beyond what they can provide, in particular for the sealing of waste dumps, the subterranean curtains or trenches are equipped with sealing strips. The sealing strips are lowered into the bentonite suspension. The connection of the sealing strips on their edges presents a problem. In the past, a number of proposals have been advanced for the connection of the edges of the strips. These proposals are based on joint strips, which are welded to the strip edges, and are inserted in one another while the sealing strips are lowered. The joint strips are complicated and expensive to install and handle. German Patent Application No. 37 12 722.5 therefore proposes that the sealing strips no longer be lowered in the longitudinal direction, but be laid out along the excavated trench, and in this position, the individual strips are welded together, until one whole strip is formed, which has the same width as the depth of the trench. For the customary trench depth of 30 m, for example, the width of the strip assembled in this manner would also be 30 m. The strip is to be lowered at the same time as the welding takes place. It has so far not been possible to implement this proposal, however, since trenches 60 m and longer cannot yet be made in one piece. In the prior art, trench walls have had to be manufactured in segments, whereby the maximum segment lengths possible are 5 m, depending on the support medium or resulting structure selected. Without a support medium or structure, a trench wall would have only a very low strength to resist ruptures. In other words, without a support medium, only very shallow or short trenches have been made. With a support medium, of course, the length cited above can be achieved, but that already requires that the bentonite slurry suspension or mixture contain significant amounts of bentonite. Such a bentonite suspension is very difficult to produce. It is produced by mixing the bentonite with water in conventional mixing drums. The higher the bentonite content, the more difficult the mixing becomes. An example of the slurry trench method is found in U.S. Pat. No. 4,696,607 entitled "Slurry Trench Method and Apparatus for Constructing Underground Walls". This document is herewith incorporated by reference as if the entire content thereof was set forth herein in its entirety.

Additional problems result with the introduction of the sealing strips in bentonite suspensions with a high concentration of bentonite. Such bentonite suspensions are very tough and difficult for the sealing strip to penetrate. They have a high moment of resistance to the introduction of the sealing strips.

Related to the proposal to lower very long sealing strips into the trenches in the ground was the proposal that a welding of the conventional type be performed on the edges of these sealing strips. The sealing strips are preferably made of steel or another weldable material. In the event that an epoxy or metal or other glue is to be used even non-metal sheets can be used. The strips are preferably of a thickness to be easily bendable in use in the exercise of the invention. In other words, the edges of the long sealing strips were to be connected to one another by overlapping welds or web welds with proven welding equipment and proven techniques. To make the weld joint possible, it was specified that the overlapping region of the sealing strips was to be surrounded by a two-piece housing, whereby one housing part would be located on the the one side of the strip and the other housing part on the other side of the strip. The housing parts have seals in the region where they contact the sealing strips, and are pumped out, so that the overlapping strip edges are readily accessible for flushing and welding. The use of the housing, including the flushing and pumping out, was considered so expensive that the use of this process seemed limited only to extremely long sealing strips.

OBJECTS OF THE INVENTION

An object of the invention is to weld even narrow sealing slips in trenches in the ground in the conventional manner.

Another object of the invention is to prepare for the welding of even narrow sealing slips in trenches.

SUMMARY OF THE INVENTION

According to the invention, the housing overlapping the strips on both sides by means of the use of the overlap region on both sides of the overlap region, is also achieved on strips which are lowered in the longitudinal direction. Therefore, they are narrow strips with a width which equals the length of trenches which previously could be produced in one piece. The invention also includes narrower strips with lesser widths. Alternatively, as seen otherwise, lengths of the strips are lowered into the trenches. The length of the strips correspond to the depth of the trenches. Along the abutting or overlapping edges of these lengthwise vertically standing strips a housing section is placed on either side of the overlapping strips and the strips are then worked to fasten them together to form a shield or sealing member against leakage of water or other liquids across the width of the trench.

According to an embodiment of the invention, after the housing spanning the overlap region is positioned, an underpressure is applied to it. The underpressure is achieved by a vacuum pump with a corresponding vacuum power. As a result of the underpressure, the housing is pressed against the strips, and the ambient pressure supports the closing of the housing and the seal.

According to an embodiment of the invention, devices are also used for welding which brace the strip edges between them, so that the welding device is guided on the strip edges, or so that the welding device fixes the strip edges in the specified welding position. According to an embodiment of the invention, such welding devices with a forward and reverse movement are used, whereby after the housing spanning the overlapping region has been pumped out and the welding surfaces flushed clean, the welding apparatus is started at the top and moved downward. The welding process then only starts with the return trip upward.

The invention also comprises an ultrasonic test for inspecting the weld seam. The commercially available apparatus for ultrasonic testing is very small, so that together with the above-mentioned welding apparatus, the space required for the housing is preferably no more than 200 mm×200 mm. Consequently, the housing can be used in trenches which have not been or do not need to be widened at the point where the housing is located. However, the housing may be larger and may even be so large in unusual circumstances for a person to be able to be lowered into the housing to conduct the welding and ultrasonic inspection operations.

Another configuration of the invention specifies that the housing simultaneously forms a bulkhead which closes the trench in the vertical direction, and/or is comprised of individual segments in the vertical direction and/or as a centering of the housing parts and/or has a guide for the edges of the strips and/or forms a part of the lowering device for the strips.

Trenches are made in segments. Each segment has a maximum length of 5 to 6 m. The maximum length is a function of the support medium selected. In other words, with an increasing proportion of bentonite in the bentonite suspension, the length of the subterranean curtain segment can be increased. On the other hand, as the proportion of bentonite increases, the handling qualities of the bentonite suspension deteriorate. It becomes extremely difficult both to mix the bentonite suspension and also to pump it, along with the lowering of the sealing strips with the necessary equipment.

When the maximum subterranean curtain length is exceeded, the bentonite suspension no longer provides the required support. There is a danger that the trench will cave in. That means that first, each underground wall or subterranean curtain segment fabricated with sealing strips must be stabilized, before the adjacent curtain segment can be started. Before the stabilization, the overlapping region of the sealing strips must be bracketed out, since otherwise a connection of the sealing strips is no longer possible. In the invention, bulkheads are used for this purpose. The bulkheads are inserted in the vertical direction, so that they are in contact with the trench region on the edge of the strip against the trench which is otherwise filled with bentonite suspension. This can be used in various ways. Either the bentonite suspension mixed with cement is again pumped out in the region of the strip edge, and this region is simultaneously filled with bentonite suspension of cement, or else only a reaction inhibitor (delaying agent) is injected, or the cement is subsequently injected into the trench region specified for stabilization on either side of the bulkhead.

According to the invention, the bulkheads are formed by at least two hoses, one of which is located on each side of the strip. The hoses—viewed horizontally—are located on one end of the housing, which is preferably designed in two pieces. Accordingly, there is a hose on each housing half. The hoses are pumped up, which can be done relatively rapidly with water. The hoses, on account of their large hose diameter, then close the trench, whereby they enclose on one side the sealing strip between them, and on the other side support the surrounding earth. The hoses thereby produce the surprising and very advantageous effect of protecting the housing parts against buoyancy while the housing is being pumped out.

After the insertion of the next sealing strips, draining or pumping of the bentonite suspension out of the housing, the strip edges are accessible for a flushing process or for the specified welding process.

The above-mentioned support of the hoses in the trench requires hose diameters, which total more than the width of the trench. Preferably, the total is less than 10% greater than the width of the trench.

Rubber is a suitable material for the hoses. When the pressure fluid is removed from the hoses, the rubber comes loose easily from the bentonite, which has hardened in the meantime. Preferably, the hoses are installed so that they protect the housing from the bentonite provided with the stabilizer.

For greater subterranean curtain depths, the housing should be comprised of individual segments. The segments are connected to one another by means of bolts or quick-release connections. The invention specifies that the hoses, too, are comprised of individual segments, which are connected to one another. The hoses are located on the segments and are installed together with the segments. The coupling parts for the hoses are bolts or quick-release connections. It is advantageous if at least one of the hose segments projects from the corresponding housing segment at the connection point between two housing segments, so that the hoses can be inserted into one another at the connection point, and cover the connection point or the coupling part. Such an arrangement is facilitated by a coupling part whose outside diameter is less than the inside diameter of the hose. For a complete coverage of the coupling part, the projecting excess length of the hose segment is at least equal to the length of the coupling part.

The connection of the housing parts is preferably achieved by the fluid pressure of the bentonite suspension column. According to the invention, this can be achieved by pressing the upper housing segments together after introducing the housing into the trench, and pumping out the bentonite suspension from above. Even with a small difference in the level of the bentonite suspension in the housing compared to the level of the surrounding bentonite suspension, the surrounding bentonite suspension develops so much application force, that the housing parts are continually pressed together, in the manner of a zipper, beginning from the upper edge and proceeding downward. This process is possible because the bentonite suspension, unlike water, flows relatively slowly through open spaces. As a result of this inertia, the difference in levels between the bentonite suspension in the housing and outside the housing required for the closing movement can be easily produced by means of commercial pumps. As a rule, a level difference of 0.5 m is sufficient. However, even 0.3 m can be sufficient. According to the invention, the pumps necessary to produce the level difference are preferably not immersed more than 1 m into the bentonite suspension in the housing.

Optionally, the closing movement of the housing can also be supported by electromagnets, or it can be produced solely by means of electromagnets. For this purpose, there can be electromagnets in the side walls of the housing, which enclose the sealing strips between them in a closed manner. It is advantageous if the electromagnets extend to the sealing strips. The force necessary to pull the housing parts together is lower, on account of a smaller gap width, than if the magnets are located on the side walls, on the side away from the sealing strip. The electromagnets can be located at uniform intervals over the length of the side walls of the housing. The magnet arrangement in question can also be linear or bar-shaped.

To limit the current feed, it may be advantageous to activate the electromagnets individually or in sequence. In other words, as soon as the gap between the side walls of the housing forming the sealing surfaces has been closed, the current feed to this magnet is either entirely turned off or throttled, and simultaneously the next magnet is activated at which there is still a gap between the sealing surfaces of side walls. For the individual activation of the magnets, the magnets are equipped individually with current feeds.

When the housing parts are lowered, it can be expected that the housing parts will need to be moved to some extent in relation to one another. This requirement can be taken into consideration in several ways. Optionally, the sealing surfaces can be made wide enough for the sealing surfaces to come together, in spite of the displacement. Optionally, the sealing surfaces can also be made narrow. In that case, there is a centering of the housing parts, to guarantee a precise contact between the housing parts. The centering can be achieved, for example, by an appropriate shaping of the side walls. Such a shaping is achieved by crease-like deformation in the area of the side walls. The crease-like deformation causes a self-centering of the housing parts. When the housing halves are put together, the crease in the one housing half is then guided into a corresponding crease in the other housing half.

It is also advantageous to position the strip edges in relation to the housing halves. This can be done by means of webs, which are welded onto the strip edges and slide in grooves or recesses in the housing parts. With such an arrangement, there is always a defined overlapping of the strip edges. This facilitates the welding process.

The webs can be welded on, for example.

Otherwise, the housing parts can form a part of the apparatus provided to lower the sealing strips. Preferably, the housing parts then form the side walls of the lowering apparatus. With such a configuration, the housing parts must necessarily be positioned together with the sealing strips. In other words, the housing parts are introduced together with the sealing strips. This is done by pulling the sealing strips with a roller, which is set up near the trench, and by means of a crane, which lowers the lowering apparatus into the bentonite suspension. The lowering device is thereby assembled in segments. After immersion of the segment of the lowering device forming the lower part into the bentonite suspension, the next segment with the housing segments forming the side walls of the device is installed. Then it is lowered further, until this segment of the lowering device is also immersed in the bentonite suspension. Following the immersion, the next segment of the lowering device is assembled and immersed. This process continues until the lowering device has reached the bottom of the trench.

Optionally, the trench is made with a length which is the same as the length of the sealing strip, and the sealing strips are laid out parallel to the trench, so that they overlap on the edges. Then the sealing strips are welded to one another outside the trench. Test welds can thereby be performed easily. Test welds are weld seals parallel to one another in the overlap region of the strips. Between the parallel weld seams there is a passage, which is filled with compressed air, to show that the weld seams are tight. A conventional air pressure is 2 bar. The sealing plane formed in this manner is moved transverse to the longitudinal direction of the individual sealing strips in the trench. This is done in segments, after a new sealing strip is welded on. During lowering, the resulting seal is flexibly supported on the edge away from the trench. This guarantees that the seal is not unintentionally lowered into the trench. To make this edge support possible, the weld seam is laid down at a slight distance from the edge of each sealing strip. For such a support, even 20 mm of free edge strips of a sealing strip may be sufficient.

In another configuration of the invention, the ends of the plastic seal are welded together so that the ends are exposed, cleaned if necessary, and then welded together producing a standing seam or an overlapping weld. Overlapping seams are advantageous.

The procedure described by the invention is advantageous for long seals, e.g. seals 60 m long, or even longer. For such long seals it is important that the seals maintain the specified path during lowering into the bentonite layer. For this purpose, according to the invention, a traverse is fastened in a known manner to the lower edge of the seal. The traverse can either be in one piece, or it can be composed of several elements. The elemental structure is advantageous, if different trench wall lengths are to be taken into consideration.

The traverse weighs so much that it guarantees the lowering of the plastic seal into the bentonite. According to the invention, the traverse is suspended with at least two traction means, e.g. cables or chains, which can be moved independently of one another or together. The lowering movement of the traverse can thereby be controlled.

According to the invention, a control of the plastic seal is preferably provided in the longitudinal direction of the plastic seal or in the longitudinal direction of the trench. This control capability comprises traction means attached diagonally to the traverse. With these diagonally acting traction means, again either cables or chains, any movement of the vertical sealing strip edge from the specified position can be prevented.

According to the invention, the strip ends are enclosed by a housing during lowering. The housing is therefore filled, like the rest of the trench, with bentonite. After complete lowering of the plastic seal, the housing slot surrounding the plastic seal is closed. This can be done, for example, by means of a hose, which is filled with pressure fluid, and is pressed either against an adjacent hose or against an adjacent plate, and encloses the plastic seal in between. Pressurization with a pressure medium is of particular advantage. Only a slight pressure is necessary. The pressure applied to the top of the housing or to the top of the hose is prepagated downward as a pressure difference. The same pressure forces are produced at all points in the system, in contrast to pressurization with compressed air. Corresponding to the one end of a plastic seal described above, there is always another end of a plastic seal, because the one curtain wall is continued into another, if subterranean curtain walls are used to enclose a waste dump or similar facility. According to the invention, in addition to the sealing end first plastic in the housing, the second, corresponding sealing end is also placed in the housing. This occurs in the same manner, either one after the other or simultaneously. The housing is also sealed simultaneously with the bracing of both plastic seal ends. After it is pumped out, the corresponding seal ends are easily accessible for cleaning and welding.

The housing can be removed after welding. However, the housing can also remain in place as an inspection shaft.

Moreover, for the performance of the trench wall seal according to the invention, there is a welding platform, on which the welding of the seal strips laid parallel to the subterranean curtain takes place. The purpose of the welding platform is to guarantee that the sealing strips do not get dirty at the welding points.

Tie rods and straps are used to hold the strip edges lying outside the trench. Preferably, the welding platform has recesses for the tie rods, so that the devices used to weld the sealing strips will not experience any interference from projecting tie rods. Significant advantages of the invention include:

Welding outside the trench

Capability of testing the weld seams outside the trench.

Significant reductions in the amount of time required to perform the work. In the prior art, the personnel specializing in laying the sealing strips must be present when the sealing strips are inserted in the longitudinal direction i.e., during the segmented erection of a subterranean curtain wall and throughout the fabrication of the subterranean curtain wall and the sealing. By means of the present invention, however, the presence of the laying specialists can be limited to a fraction of the time according to the present invention. In other words, during the preparation of the trench, the presence of a laying specialist for the sealing strips is not necessary.

The method of laying the strips according to the invention also makes possible the use of pre-welded sealing strips. In such a case, two or more sealing strips can be welded under more favorable conditions than at the work site, e.g. in the manufacturing plant or at another location with optimal conditions. Strip widths of 2 m or 6 m, for example, can be produced. The very wide strips fabricated in this manner significantly reduce the amount of time required for sealing.

One aspect of the invention resides broadly in a method for use in a trench containing a slurry material, this method being for preparing for fastening of sealing strips placed in the trench, the trench having contained therein at least the slurry material for stabilizing the walls of the trench. The method is comprised of digging a trench; at least partially filling the trench with a slurry material therein; lowering the housing arrangement into the slurry in the trench; lowering sealing strips vertically into the underground trench to locate the edges of adjacent strips in position to join the edges of the adjacent strips to one another; the housing arrangement being placed on both sides of the sealing strips adjacent at least one of the adjacent edges of the adjacent strips to be joined; and pumping out the slurry material in the housing arrangement.

Another aspect of the invention resides broadly in a method for use in a trench containing a slurry material, this method being for fastening sealing strips placed in the trench having contained therein at least the slurry material for stabilizing the walls of the trenches. The method is comprised of lowering sealing strips vertically into the underground trench to locate the edges of at least two adjacent strips in positions to join the edges of the at least two adjacent strips to one another; the housing arrangement being placed on both sides of the sealing strips adjacent at least one of the adjacent edges of the adjacent strips to be joined; pumping out the slurry material in the housing arrangement; and joining the edges of at least two adjacent strips.

Yet another aspect of the invention resides broadly in an apparatus for fastening sealing strips in an underground trench having at least a filler material for stabilizing the walls of the trenches, and for use in a method. This method is comprised of lowering sealing strips lengthwise and vertically into the underground trench to locate the edges of adjacent strips in positions to Join the edges of the adjacent strips to one another; placing a housing arrangement on both sides of the sealing strips at least one of the edges of the adjacent strips adjacent to be joined; pumping out slurry material in the housing arrangement; and joining the edges of at least two adjacent strips wherein the housing arrangement comprises two portions, one for being disposed on one side of the strips and the other for being disposed on another side of the strips, the housing arrangement having two halves for being placed on each side of one of the at least one of the adjacent edges of the adjacent strips to be joined; an arrangement for pumping out said filler material in the housing arrangement; and an arrangement for joining said adjacent edges of the adjacent strips to be joined.

BRIEF DESCRIPTION OF THE DRAWINGS

The accompanying figures represent various embodiments of the invention.

FIG. 20 shows a portion of FIG. 2 with a bladder pump assembly;

FIG. 21 shows an electromatic control circuit for electromagnets; and

DESCRIPTION OF THE PREFERRED EMBODIMENTS

Figure 1:
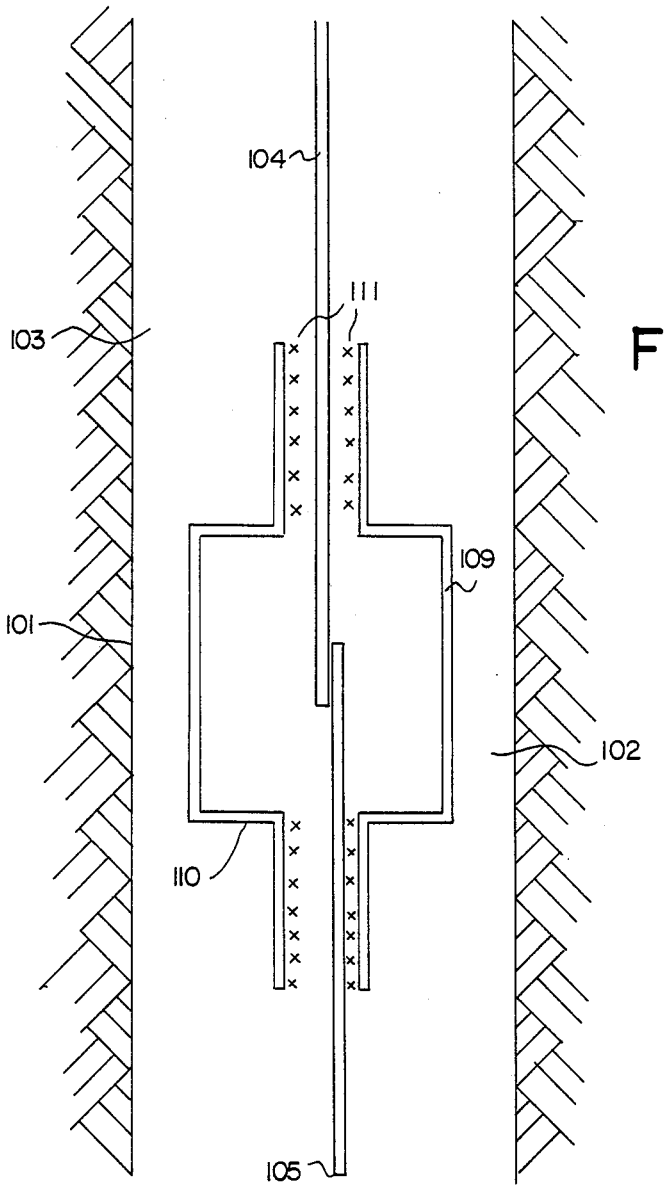
FIG. 1 is a plan view of a trench containing bentonite with the sealing strips and the housing disposed about joints between the sealing strips.

In FIG. 1 through 3, 101 is a trench 400 mm wide. The trench 101 is 30 m deep. The trench 101 has been produced with simultaneous filling with bentonite suspension. After the trench 101 is dug, sealing strips 104 and 105 are lowered into the trench 101. The sealing strips 104 and 105 are lowered so that their edges overlap.

On both sides of the sealing strips 104 and 105, there are housing halves 109 and 110, which bridge the overlap region. The housing halves 109 and 110 have seals 111 at the contact points with the sealing strips 104 and 105.

The housing halves 109 and 110 consist of U-shaped steel profiles which together form a cavity 200 mm×200 mm. The cavity is sufficient to introduce a suction line into the housing, and to produce a sudden underpressure inside the housing by applying a high suction force. The overpressure which is produced outside the housing causes the housing halves to be pressed together against the sealing strips 104 and 105. In this state, the inside of the housing can be pumped out. Then the sealing strips are flushed with water in the overlapping region, the flushing water is pumped out, and a conventional welding apparatus which moves forward and backward is put in place. The welding apparatus first travels down to the bottom of the trench. There, the welding apparatus is commanded to start a heated wedge. Welding can optionally be done using a hot air operation. The welding process begins with the reverse movement. Then the overlapping region is closed from bottom to top. At the same time, the weld seam is tested with ultrasound. The test is performed by a test head fastened to the welding device. The test head is located behind the welding apparatus, in the direction of welding. Hoses 106 and 107 are mounted on the side walls 114. The hoses 106 and 107 consist of rubber-coated webs. The hoses 106 and 107 can be fastened to the side walls 114, e.g. by means of fastening strips. The hoses 106 and 107 are braced between the fastening strips and the side walls 114. The fastening strips make it possible to use sections, which are connected to the side walls only by means of clamps and formed into hoses. The diameter of the hoses 106 and 107 is designed so that the total of the diameters is 1.5 times the distance between the trench walls 101.

The hoses 106 and 107 are closed at the base 116. This closing can also be produced by clamps. The hoses 106 and 107 can optionally also be clamped at the upper end. Integrated into the clamp is a valve for filling the hoses 106 and 107 with pressure medium. When the pressure medium 108 is pumped in, the hoses 106 and 107 swell up and are pressed against the trench walls 101, and brace the sealing strips 105 and the side walls 114 of the housing halves 109 and 110 between them. The hoses 106 and 107 thereby press against the housing halves 109 and 110 and the side walls 114, so that the space 102 in the trench is bulkheaded against the housing halves 109 and 110 and the overlap region 115.

When the trench is excavated, bentonite suspension is simultaneously filled into the trench. The bentonite suspension has been mixed with cement, so that solidification occurs in the vicinity of the trench. The trench is constructed in sections. When the area 102 is excavated, the trench has been extended to a length whose limit is indicated by a dotted line at 117 in FIG. 3. This limit is in the trench area 103. After excavating the trench section for area 102 up to the limit 117, and simultaneously filling it with bentonite suspension, the sealing strip 105 is introduced. Then, on both sides of the sealing strip 105, the housing halves 109 and 110 with the hoses 106 and 107 are lowered. After pumping up the hoses 106 and 107, an inhibitor is injected into the bentonite suspension, which is in the area of the trench from the hoses 106 and 107 to the limit 117. The inhibitor prevents solidification of the bentonite suspension. This is necessary to be able to erect the subsequent trench section for the area 103, connected to the strip 104. After erection of the trench section for the area 103, the inside of the housing 109, 110 is pumped out. A suitable pump for this purpose is an immersion pump, which is placed on the suspension surface in the housing, and whose suction tube is immersed in the bentonite suspension, and has only a short suction path for the bentonite suspension. Then the pump transfers the bentonite suspension through a pipeline into a recipient.

In the embodiment, the pumping-out of the housing 109, 110, after a level difference of 0.4 mm is obtained between the suspension inside the housing and outside the housing 109, 110, causes the housing halves 109 and 110 to be pressed together by the suspension pressure. The housing halves 109 and 110 thereby enclose the sealing strips 104 and 105 tightly between them. The sealing strip 104 has been lowered into the trench after the fabrication of the trench section for area 103 and before the beginning of the pumping process.

The sealing strips 104 and 105 advantageously form seals for the housing 109 and 110.

Like the hoses 106 and 107, the housing 109 and 110 is closed at the base 112. For this purpose, the housing halves 109 and 110 are equipped with a base plate.

During and after the pumping-out of the housing 109, 110, the hoses 106 and 107 hold the housing in the specified position, on account of their application force against the trench walls 101, against the buoyant forces acting on the housing 109, 110, as it is pumped out.

After the housing 109, 110 is evacuated, the overlapping strip edges are flushed with water. The water is pumped out by the pump located at the base of the housing. Then a welding apparatus is placed at the top of the sealing strips 104 and 105, enclosing the overlapping strip edges between guide rollers, and is first moved to the base of the housing by a drive roller, before the welding process is started. The apparatus then welds the overlapping strip edges together on its reverse movement upward. Commercially available welding equipment can be used for this welding process, such as those which are used to produce overlapping welds on sealing strips on roofs.

After the welding, the housing 109, 110 is again filled with suspension, and the hoses 106 and 107 are depressurized. The housing halves 109 and 110 can be removed from the trench after depressurization.

Figure 4:
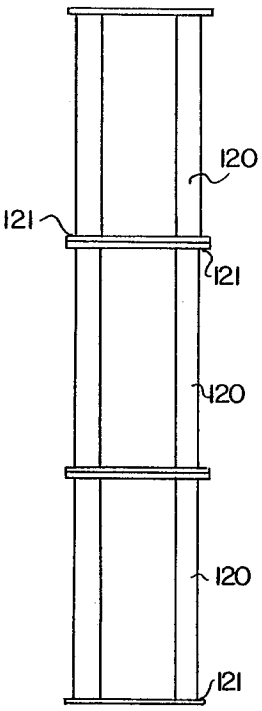
FIG. 4 shows an embodiment of the invention with a housing for trenches which are very deep.
Figure 3:
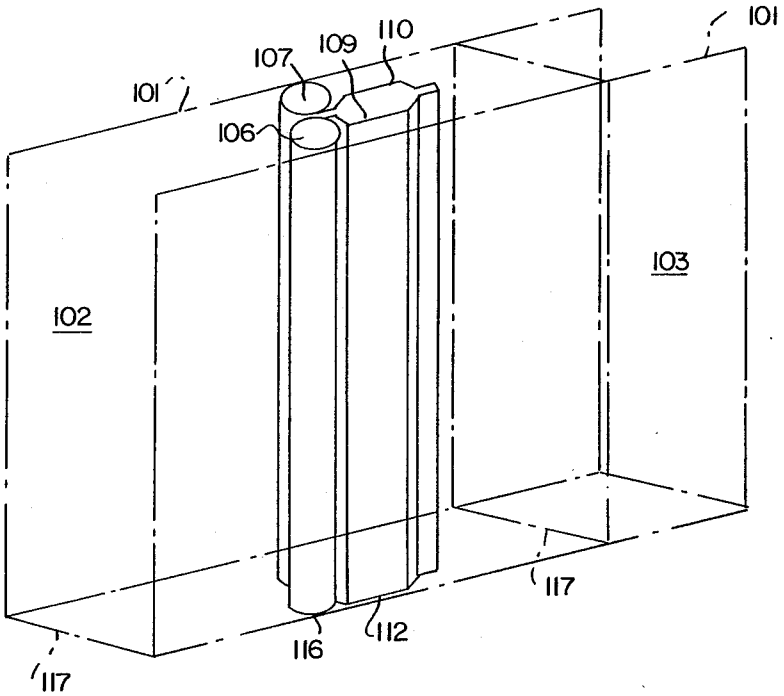
FIG. 3 is a perspective view of the trench and an embodiment of the invention disposed therein.

FIG. 4 shows a housing for trenches which are particularly deep. The housing for such trenches consists of sections 120, which are equipped with collars 121, and are bolted together at these points. Instead of bolts, quick-release fasteners, e.g. clamping levers, can also be used.

Figure 6:
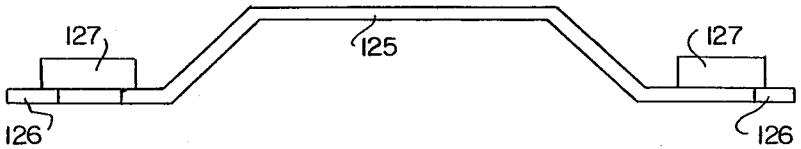
FIG. 6 shows a top view of housing sections according to an embodiment of the invention.
Figure 5:
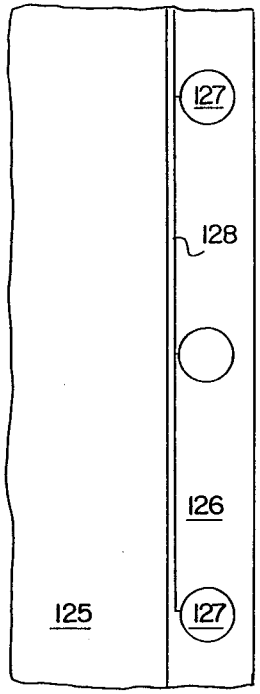
FIG. 5 shows an elevation view of the housing sections according to an embodiment of the invention.

FIGS. 5 and 6 show housing sections 125 with side walls 126. The side walls 126 are provided with holes for magnets 127. The magnets are uniformly distributed over the length of the side walls 126. The magnets 127 can be energized by means of lines 128. The magnets 127 can be controlled individually. In another embodiment of the invention, these magnets are used to assist the closing motion of the housing halves. After energizing the electromagnets 127, the magnets 127 located on the housing section 125 are attracted to the opposite housing section made of steel.

Figure 7:
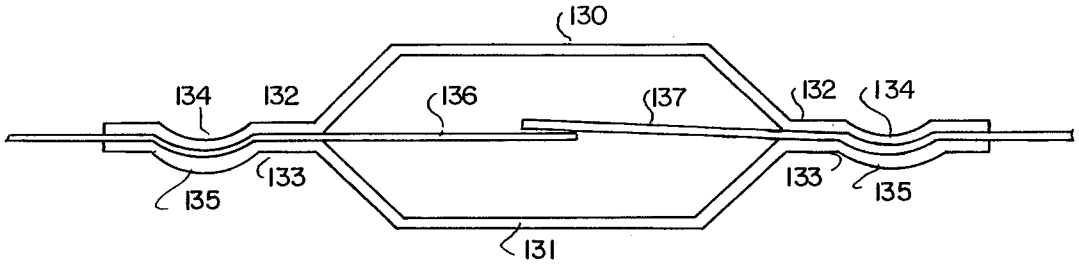
FIG. 7 shows self-centering housing halves according to an embodiment of the invention.

In another embodiment, FIG. 7 shows self-centering housing halves 130 and 131. The housing halves 130 and 131 have side walls 132 and 133. The side walls 132 are provided with crease-like deformations 134 outward, and the side walls 133 with crease-like deformations 135 inward. The creases 134 and 135 are designed so that they fit together.

The sealing strips 136 and 137 in the embodiment illustrated in FIG. 7 are braced between the housing halves 130 and 131. The advantage of the creases 134 and 135 lies in the centering or guidance of the housing halves 130 and 131 during closing of the housing.

As described above, the closing movement begins at the top of the housing, in the manner of a zipper, when the housing is pumped out. During this closing movement, the creases 134 fit into the creases 135. As the closing proceeds, there is a correction of the position of the two halves of the housing.

Figure 8:
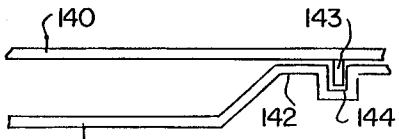
FIG. 8 shows an alternative embodiment of the invention with a sealing strip and housing halves.

FIG. 8 shows one embodiment of the invention with a sealing strip 140 and housing halves 141, which have side walls 142, whereby the sealing strip 140 has a welded-on web 143. The web 143 slides in a groove 144 of the side wall 142. The web in the embodiment is 10 mm high. The groove 144 is formed by bevelling the side wall 142, or by a suitable welded structure. The web 143 and the groove 144 form a guide for the strip 140.

Figure 9:
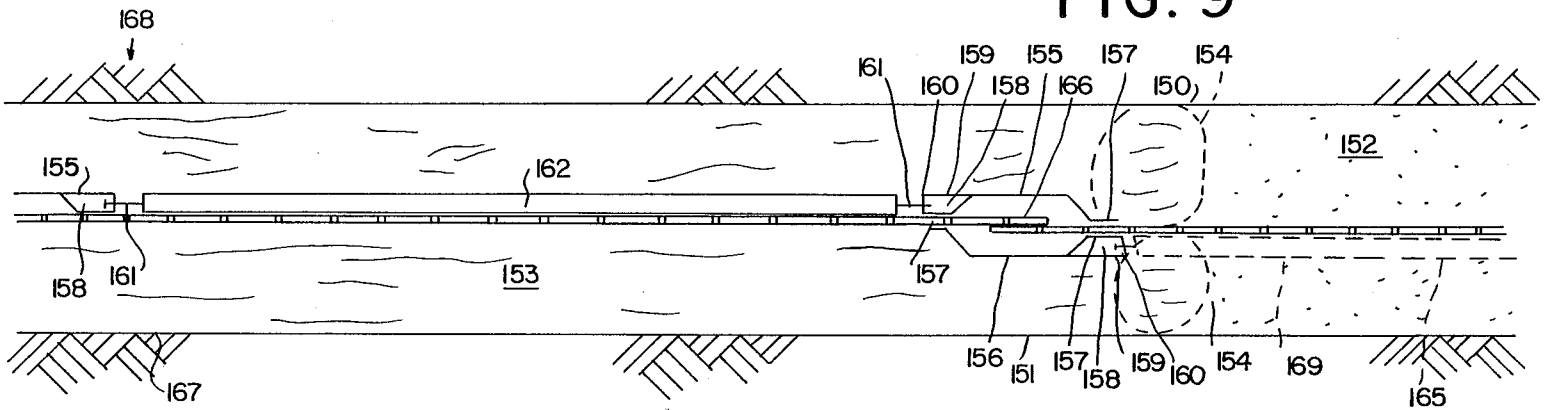
FIG. 9 shows a plan view of a trench with subterranean curtains.

FIG. 9 illustrates a trench with trench walls 150 and 151. In the trench, in the area 152, cement has already been used to stabilize the bentonite suspension. In region 153, on the other hand, there has not yet been any stabilization of the bentonite suspension. As in the embodiment in FIG. 1 and 2, hoses have been used to delimit the areas 152 and 153. The hoses are indicated as dotted lines in FIG. 9 and are identified with number 154. The hoses 154 are fastened to housing halves 155 and 156, which have guides 158 next to the side walls 157. The guides 158 are each formed by a side wall and a web 159, and bent portions 160 on the end of the web 159, or on the end of the corresponding side wall 157.

Figure 10:
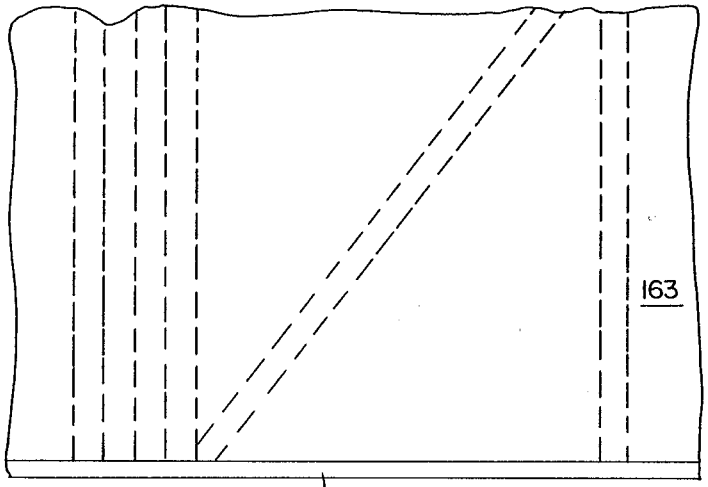
FIG. 10 shows an embodiment of the invention with a contact surface shown in detail.

A frame portion of the lowering apparatus for the sealing strips is engaged in the guide 158 by means of a T-shaped head 161. This part of the lowering apparatus is numbered 162, and is provided on the side of the sealing strip with a contact surface 163 for the sealing strip formed by sheet metal or by a grid structure. The contact surface is indicated in FIG. 10. FIG. 10 also shows that the apparatus to lower the sealing strip has a clamping strip 164 on the base. The clamping strip 164 is electromechanically activated, and clamps the lower edge of the sealing strip to be inserted.

The part 162 consists of a grid structure, which can be optionally reinforced by diagonal members.

As indicated in FIG. 9, the trench has been fabricated in area 152 with a sealing strip 165. The housing halves 155 and 156 are opened, so that the sealing strip marked 166 can be lowered with the lowering apparatus. The head 161 slides in the guide 158, while the contact surface 163 with the clamp 164 is threaded with the sealing strip between the two housing halves 155 and 156. The guidance of the lowering apparatus with the head 161 in the housing half 155 guarantees that the sealing strip 166 reaches its specified position. It is also thereby possible to prevent the housing half 155 from being displaced by the hoses 15. Optionally, the activation of the hoses 154 can be eliminated, if the lowering apparatus can be moved with a precision of several centimeters, e.g. by means of lateral traction cables.

In the lowering apparatus described above, tee housing half 155 for the next overlapping area is simultaneously lowered with part 162. The housing half 155 for the next overlapping area is bolted or clamped to the part 162 in a manner not shown.

Figure 2:
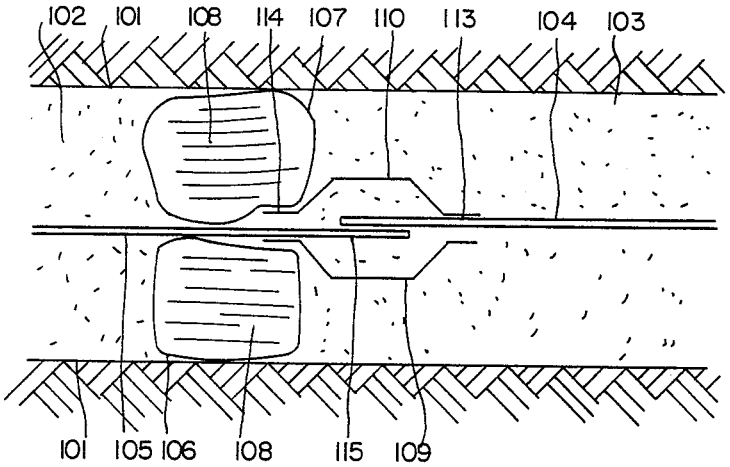
FIG. 2 shows a plan view of an alternative embodiment of the invention as shown in FIG. 1 having in addition disposable bladders disposed in the trench.

After the end of the lowering motion, the inside of the housing 55, 156 is pumped out, and the sealing strips 165 and 166 are welded in their overlapping region, as in the embodiment illustrated in FIG. 1 and 2. Then the housing 155, 156 is flooded with bentonite suspension, and the part 162 with the housing half 155 so the just-welded overlapping region is pulled out of the trench, while the housing half 155 for the overlapping region to be welded next is left in the trench, by loosening the bolts or releasing the connection. On the other hand, the housing 155 of the just-welded overlapping area is bolted or clamped with the part 162, to be extracted.

The housing half 156 opposite the housing half 155 is extracted either together with the part 162 and the housing half 155, or separately.

To introduce the sealing strip 166, the sealing strip 166 is pulled by a roller, which has been set up on the side 167 of the trench. For the next sealing strip to be pulled in, the strip roller is located on the side 168. The part 162 is again used, but in a position which is pivoted by 180 degrees, as shown in FIG. 9 by the dotted line at 169 for sealing strip 165.

Figure 11:
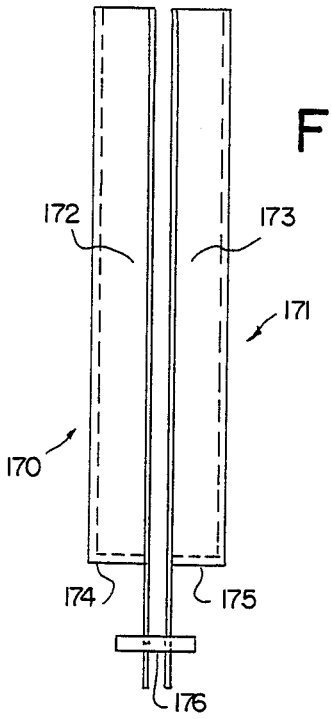
FIG. 11 shows an embodiment of the invention with the housing parts having a bottom.
Figure 12:
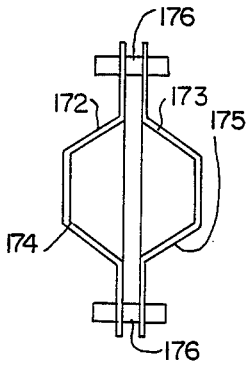
FIG. 12 shows a plan view of FIG. 11.

In another embodiment illustrated in FIGS. 11 and 12, the housing parts 170 and 171 are lowered into the trench, before the sealing strips are lowered. In other words, the sealing strips are then pulled in between the housing parts 170 and 171. A prerequisite is that there is a sufficient clearance between the housing parts. The gap width must be at least equal to the thickness of the sealing strip. The clearance width is preferably significantly greater.

The housing parts 170 and 171 are held on the bottom by bolts 176. The bolts give the housing parts 170 and 171 sufficient play, and are released before the housing parts 170 and 171 are extracted after the welding of the overlapping strip edges. The housing parts 170 and 171 comprise bevelled profiles 172 and 173, and sheet metal parts 174 and 175.

Figure 13:
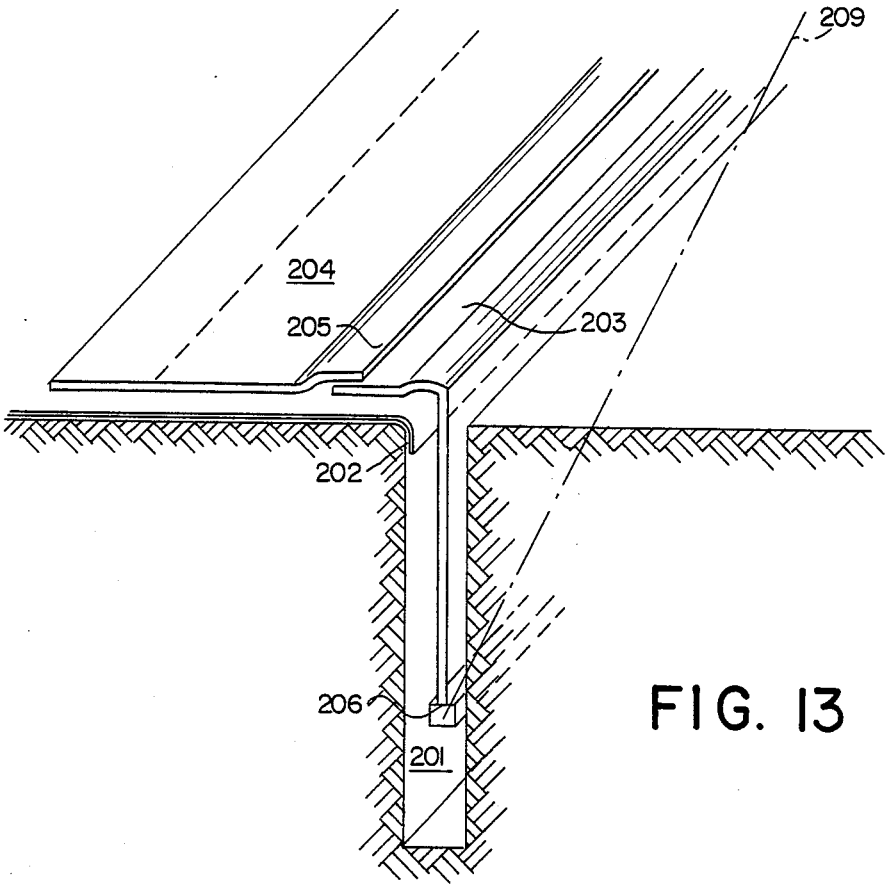
FIG. 13 shows the sealing strips being lowered into the trench.
Figure 14:
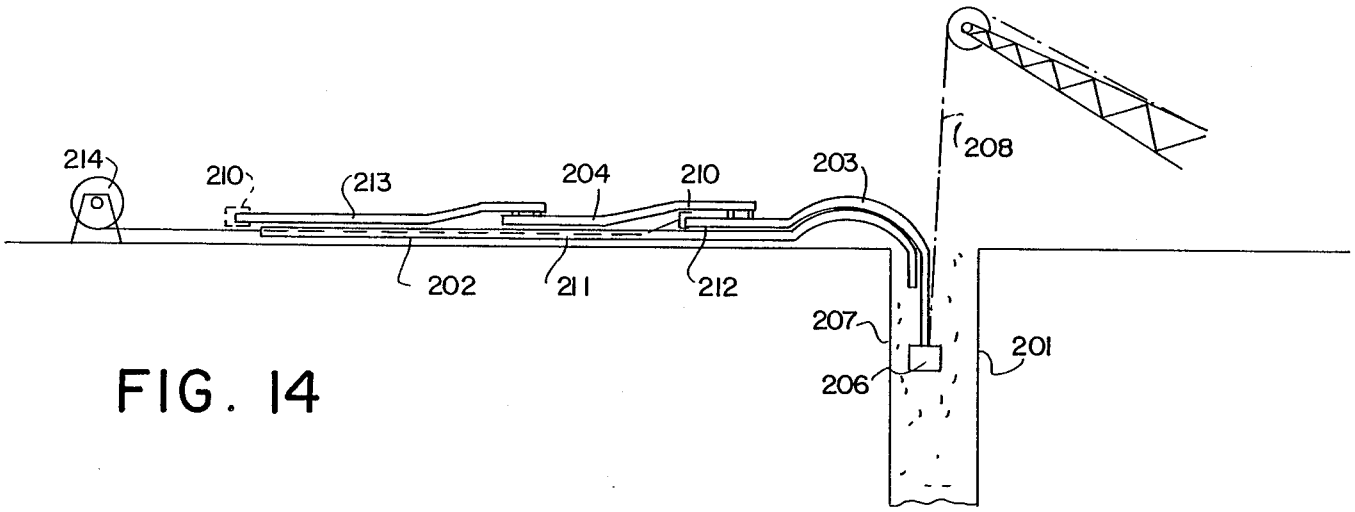
FIG. 14 shows an alternative embodiment of the invention relating to the sealing strips being lowered into a trench.

FIG. 13 shows a trench 201, which has been constructed over its entire length, e.g. 60 m, by means of an excavator. As the trench was excavated, bentonite suspension was simultaneously injected into the trench. The bentonite suspension protects the trench from cave-in. As shown in FIG. 14, on one side of the trench, there is a welding platform 202. The welding platform 202 extends along the trench 201. On the welding platform 202, the sealing strips 203 and 204 are laid out parallel to the trench 201, and are welded to one another in the overlapping region 205. Then a test weld is performed. The test weld consists of two parallel weld seams next to one another. In the embodiment, the distance between the weld seams is 10 mm. The passage formed is pressurized with compressed air after the weld has been made and the ends of the passage closed. If there is no loss of pressure, the weld seam can be assumed to be sufficiently leakproof. The test pressure in the embodiment is 2 bar.

The plastic seal made by welding the sealing strips 203 and 204 is lowered with one end, to which a traverse 206 is fastened, into the bentonite suspension marked 207. The traverse 206, consisting of individual steel beams, is suspended at intervals by means of traction cables 208 by cranes, or suitable winches. The cranes or winches have drives which can be controlled individually, so that a desired inclination of the traverse 206 can be achieved during lowering, or a perfectly horizontal position. At the same time, two cables 209, one of which is indicated in the form of a dotted line in FIG. 13, prevent the seal from bowing in the longitudinal direction of the trench 201. The cables 209 are engaged in the terminal region of the traverse 206, and run diagonally across one another to the end of the trench. Two appropriate winches work together with the cables 209.

The desired position of the traverse or of the lower edge of the seal, or of the lateral edges of the seal, can be controlled by means of tie rods, which are inserted into one another as the lowering movement proceeds, so that as the lowering proceeds, they indicate the position of the traverse 206 with the portion of the rod projecting out of the trench and the bentonite slurry. These rods can also be used, after a successful lowering of the seal, to release the traverse from the lower edge of the seal, so that the traverse 206 can be recovered. For this purpose, the traverse 206 has optional clamping devices for the lower edge of the seal.

Optionally, too, a disposable traverse 206 can be used. In other words, the traverse 206 remains in the trench 201 after the lowering has been completed.

During lowering, the edge of the seal away from the trench 201 is supported by straps 210 and tie rods 211. In the embodiment, the straps 210 are engaged in the projecting strip edge 212 left exposed when the overlapping weld was performed. In the embodiment, the strip edge is 30 mm wide. As shown in FIG. 14, the welding platform 202 has recesses for the tie rods 211. Therefore, the sealing strips laid on the welding platform 202 can also lie flat, and the tie rods do not interfere with the welding equipment.

FIG. 14 shows that one strip edge is always held by straps 210. In the embodiment illustrated in FIG. 14, as soon as the strips 203 and 204 have been welded with another strip 213 in the manner described above, the exposed edge of the strip 213 is grasped by a strap 210 shown as a dotted line, before the straps grasping the strip edge 212 are released. The various tie rods 211 are activated by means of appropriate winches 214.

Figure 15:
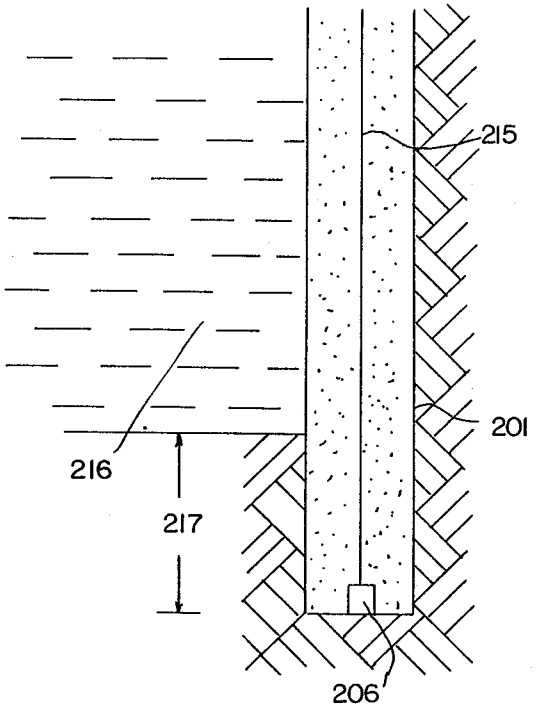
FIG. 15 shows an embodiment of the invention with a seal used to seal a contaminant area of ground.

As shown in FIG. 15, the seal 215 is to be used to seal a contaminated area of ground 216. The trench 201 extends beyond the contaminated area 216 into a stratum which is impermeable to water. In the embodiment, the excess depth 217 of the trench 201 is 2 mm. Such an excess depth guarantees that no contaminated water will penetrate through the bentonite layer and below the lower edge of the seal 215.

Figure 16:
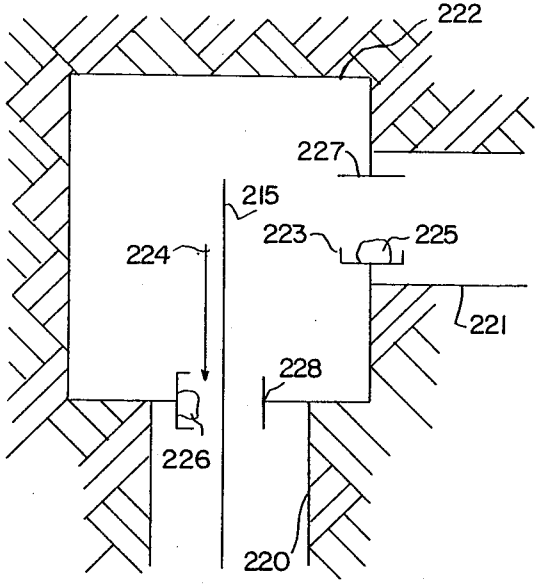
FIG. 16 shows a plan view of a connection between two trenches.

FIG. 16 shows the connection of two adjacent trenches 220 and 221. In the ground at the connection point, there is a housing 222 consisting of sections. The housing 222 has openings 223 and 224 toward the trenches 220 and 221, which allow an easy introduction of the seal 215. If both trenches 220 and 221 have a seal 215, the openings 223 and 224 are closed. This is done by means of hoses 225 and 226. There is a hose at each opening. The hose is fastened to the lower end of the lower section of the housing 222, and is closed on the bottom. As the lowering of the housing sections proceeds, the hose is pulled down along with it.

After the introduction of the seals 215, the hoses 225 and 226 are filled with water under pressure. A fluid pressure of 1 bar is sufficient, which causes the hoses 225 and 226 to swell up. The seals 215 are thereby pressed against abutments, so that there is a seal at the openings 223 and 224. When pressurized liquid is used, the above-mentioned fluid pressure of 1 bar as a difference from the ambient pressure is present even in the lowest section of the housing.

After the sealing, the housing 222 is emptied with a pump (not shown). Then the ends projecting into the housing 222 can be cleaned, and connected to one another, e.g. by means of an overlapping weld. After the welding is performed, the housing 222 can be re-filled with bentonite, and removed after opening the openings 223 and 224.

Figure 17:
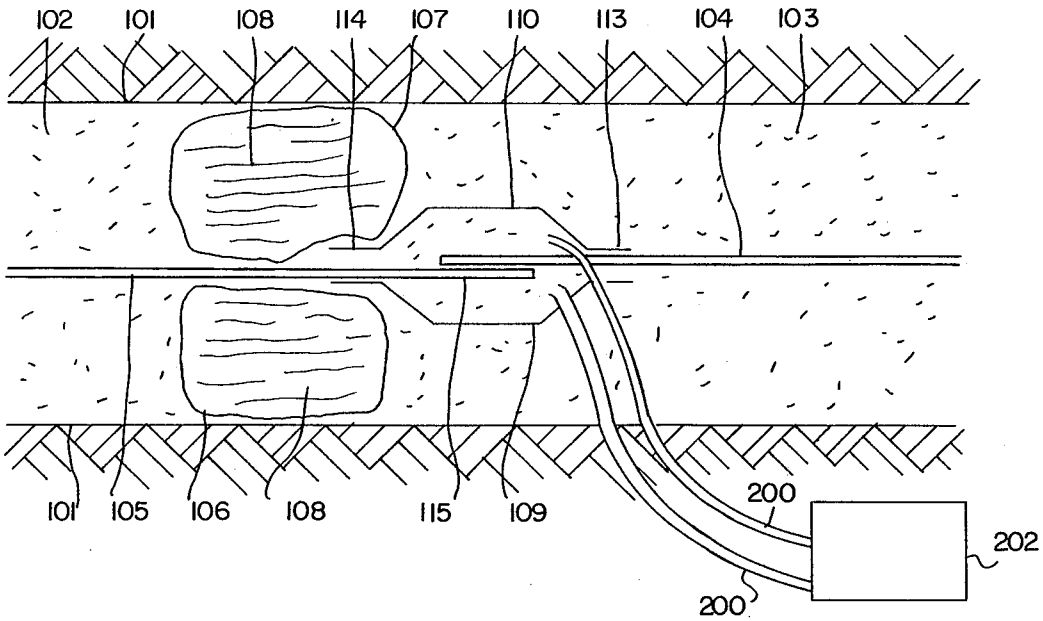
FIG. 17 shows a portion of FIG. 2 with a pump assembly.

In FIG. 17, hoses 200 are shown which pump out the bentonite slurry between the sealing strips 104, 105 and the housing parts 109, 110. These hoses are connected to a pump 202 for rapid evacuation of the bentonite slurry from the housing parts 109, 110.

Figure 18:
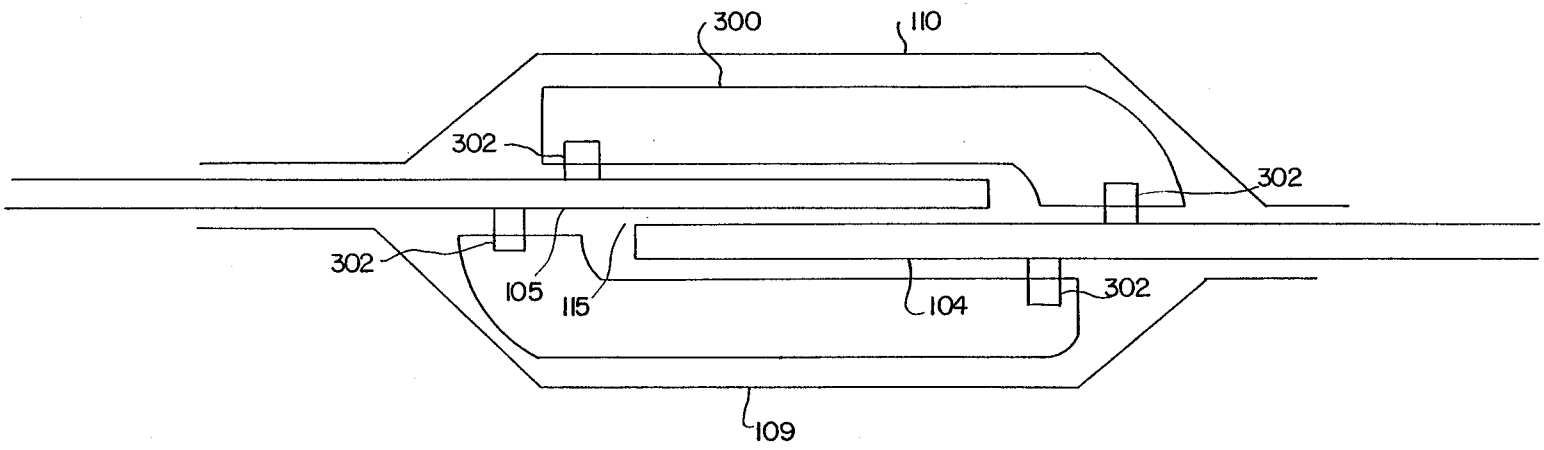
FIG. 18 shows a welding arrangement for welding an embodiment of the invention.

FIG. 18 shows a welder 300 disposed within the housing parts 109, 110 for welding the strips 104, 105. The welder 300 is lowered by lowering means such as wire ropes, cables, retractable or movable shafts or possibly even chains into the housing parts 109, 110. The weld is preferably started at the bottom of the trench and the strips 104, 105 are welded in the overlap region 115 from the bottom up. The welder 300 may be an electric arc welder or even a gas-type welder such as acetylene oxygen unit. The welder 300 has wheels 302 placed at both sides of the welder for steadying the welder against the sealing strips 104, 105. These wheels 302 may be magnetized for holding the welder against the sealing strips 104, 105 and also preferably for drawing the sealing strips 104, 105 together to assist in the welding operation. Appropriate cables to power the welder or tubes which are not shown are connected to the welder and are raised and lowered with the welder in the trench. In an alternative embodiment, the welder may have a second side on the other side of the sealing strips 104, 105 which is shown in FIG. 18.

Figure 19:
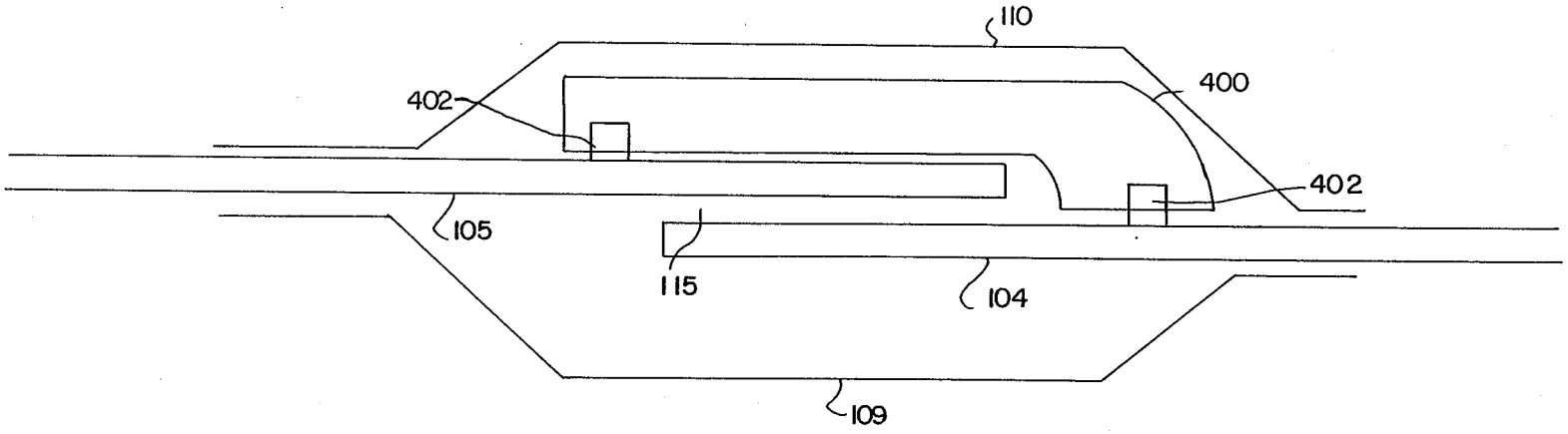
FIG. 19 shows an ultrasonic inspection arrangement for inspecting the sealing surface.

FIG. 19 shows an ultrasonic inspection unit 400 which can operate analogous to the welder 300 as shown in FIG. 17. The ultrasonic inspection unit also has wheel 402 to hold it in the proper orientation with respect to the weld between the sealing strips 104, 105.

FIG. 20 shows hoses 500 for pumping out the slurry in the hoses 106, 107. These hoses 500 are connected to a pump 502. The pump may in alternative embodiment be disposed in the hoses as submersible pumps.

FIG. 21 shows an alternative embodiment of FIG. 6 with an electromagnetic control circuit 600 for controlling the electromagnets 127.

Figure 22:
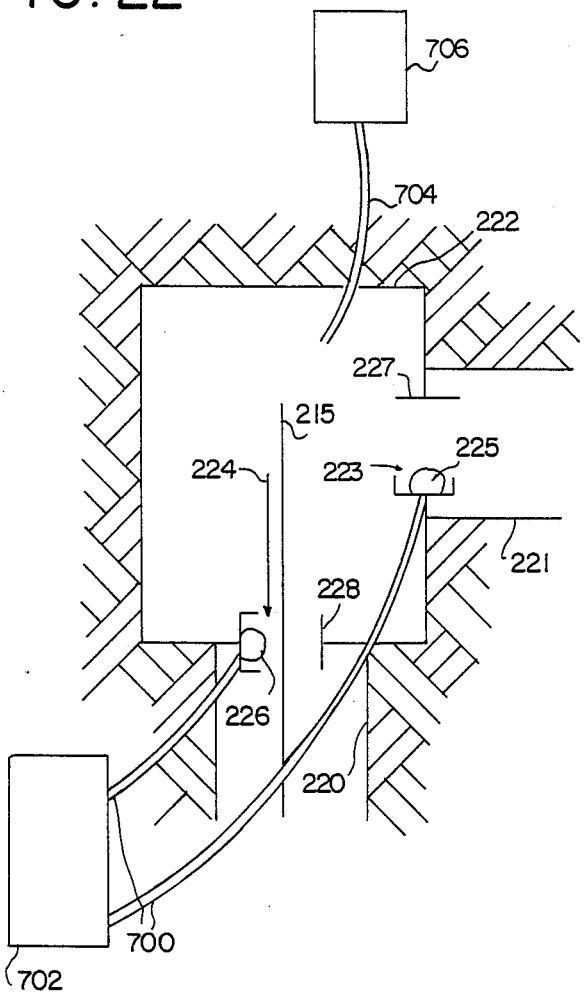
FIG. 22 shows a more detailed drawing of FIG. 16 with pump assemblies therein.

FIG. 22 shows hoses 700 connected to hoses 225, 226. These hoses 700 are connected to a pump 702. The pump 702 includes a control system for controlling the pump and the pressure in the hoses 700. An additional hose 704 is shown for pumping out the slurry from housing 222. Connected to the hose 704 is a pump 706.

In summing up, one aspect of the invention resides broadly in a process for welding sealing strips in subterranean curtains with bentonite filler or similar material characterized by the use of housings 109, 110 which can be pumped out and which span the overlap region on both sides of the curtains on sealing strips 104, 105 which are lowered in the longitudinal direction.

Another aspect of the invention resides broadly in the fact that by a high suction force, a sudden underpressure is created inside the housing.

Yet another aspect of the invention resides broadly to the fact that the housing is pumped empty from above, and the suction line extends no deeper than 1 m into the bentonite suspension.

A further aspect of the invention resides broadly in the use of welding equipment with the strip edges between tensioning rollers with forward and backward motion, whereby the welding apparatus starts out in the upward position, is then lowered without welding, and the welding takes place during the reverse movement upward.

A yet further aspect of the invention resides broadly to an ultrasonic test of the weld seam.

Yet another further aspect of the invention resides broadly in the fact that the housing 109, 110, 155, 156 simultaneously forms a bulkhead closing the trench in the vertical direction, and/or is made up of individual segments 120 in the vertical direction and/or has a centering of the housing parts 130, 131 and/or a guide 143, 144 for the strip edges, and/or forms a component of the lowering apparatus 162 for the strips.

An additional aspect of the invention resides broadly in the fact that the housing parts 109, 110 are equipped on their end 114 with inflatable bladders or hoses 106, 107, 154.

A yet additional aspect of the invention resides broadly in the fact that the hoses 106, 107, 154 are located on both sides of the strip.

A further additional aspect of the invention resides broadly in the fact that the hoses 106, 107, 154 have diameters, the sum of which is greater than the distance between the subterranean curtains.

A yet further additional aspect of the invention resides broadly in the fact that the hoses 106, 107, 154 of housing segments can be coupled together, and at least one hose end projects out from the corresponding housing segment, and the coupling pieces have an outside diameter which is less than the inside diameter of the hose.

Another further additional aspect of the invention resides broadly in the fact that the hoses 106, 107, 154 have at least a rubber coating.

A yet another additional aspect of the invention resides broadly in the fact that the hose segments are bolted to one another.

Another yet further aspect of the invention resides broadly in the fact that the hose segments 126 are equipped with electromagnets 127.

A still further aspect of the invention resides broadly in the fact that the electromagnets 127 can be activated and controlled individually.

A still further additional aspect of the invention resides broadly in the fact that the housings 130 1 131 are self-centering.

Another still further additional aspect of the invention resides broadly in the fact that the side walls of the housings 130, 131 are guided into one another.

Yet another still further additional aspect of the invention resides broadly in the fact that the sealing strips 140 are guided with webs 143 in the housings 141.

Still another yet further additional aspect of the invention resides broadly in the fact that the housing parts 155, 156 form part of the lowering apparatus for the sealing strips 165, 166.

Another still further yet additional aspect of the invention resides broadly in the fact that the housing parts 155, 156 form the side walls of the lowering apparatus.

Another aspect of the invention resides broadly in two housing parts 170, 171, with floors 174, 175, which housing parts can be inserted before the insertion of the sealing strips.

Yet another aspect of the invention resides broadly in a releasable connection 176 of the housing parts 170, 171 on the lower end, which has a certain amount of play, which is at least equal to the thickness of the strips.

Still another aspect of the invention resides broadly in the fact that a sealing strip is comprised of individual sealing strips 203, 204, 213, which are laid out parallel to the subterranean curtain wall 201 and are welded with their edges overlapping.

Yet still another aspect of the invention resides broadly in the fact that the laid out and welded sealing strips 203, 204, 213 are held during lowering on the edge 212 away from the trench 201.

A further aspect of the invention resides broadly in a traverse 206 fastened to the lower edge of the seal, which traverse is suspended by at least two traction mechanisms 208, which can be controlled independently of one another and jointly with one another.

A yet further aspect of the invention resides broadly in additional traction mechanisms 209, whose traction direction runs diagonally to that of the first traction mechanism 208, and which can be moved independently of the first traction mechanism 208.

Yet another further aspect of the invention resides broadly in a housing 222, which holds the ends of the seal 215 and has closable openings 223, 224.

An additional aspect of the invention resides broadly in the fact that the housing 222 has at least one hose 225, 226 at the openings 223, 224.

A yet additional aspect of the invention resides broadly in a fluid charge for the hose 225, 226.

A further additional aspect of the invention resides broadly in a pump for the housing 222.

A yet further additional aspect of the invention resides broadly in a welding platform 202.

Another further additional aspect of the invention resides broadly in tension rods 211.

A yet another additional aspect of the invention resides broadly in the fact that the welding platform 202 has recesses for the tension rods 211.

An example of a portable welder is found in U.S. Pat. No. 4,100,391 entitled "Portable Seam Welder". Some examples of ultrasonic flaw detectors are found in U.S. Pat. No. 4,531,413 entitled "Ultrasonic Flaw Detector Driving Apparatus of a Trackless Type". Another example of this is found in U.S. Pat. No. 4,211,118 entitled "Ultrasonic Fault Detector". All the above-cited documents whether U.S. or Foreign are herewith incorporated by reference as if the entire contents thereof were set forth herein in their entirety.

The invention as described hereinabove in the context of a preferred embodiment is not to be taken as limited to all of the provided details thereof, since modifications and variations thereof may be made without departing from the spirit and scope of the invention.

What is claimed is:

1. Method for use in an underground trench containing a slurry material, said method being for preparing for fastening of sealing strips placed in the underground trench, the underground trench having contained therein at least the slurry material for stabilizing the walls of the underground trench, said method comprising the steps of:

(a) digging an underground trench;

(b) at least partially filling the underground trench with a slurry material therein;

(c) lowering housing means into the slurry in the underground trench;

(d) lowering sealing strips vertically into the underground trench to locate the edges of adjacent strips in position to join adjacent edges of the adjacent strips to one another;

(e) placing said housing means on both sides of the sealing strips adjacent at least one of the adjacent edges of the adjacent strips to be joined; and (f) pumping out the slurry material from within said housing means.

2. Method for use in an underground trench containing a slurry material, said method being for fastening sealing strips placed in the underground trench having contained therein at least the slurry material for stabilizing the walls of the underground trench, said method comprising the steps of:

(a) lowering sealing strips vertically into the underground trench to locate the edges of at least two adjacent strips in positions to join adjacent edges of the at least two adjacent strips to one another;

(b) placing housing means on both sides of the sealing strips adjacent at least one of the adjacent edges of the adjacent strips to be joined;

(c) pumping out the slurry material in said housing means; and (d) joining the edges of at least two adjacent strips.

3. Method for use in an underground trench containing a slurry filler material for fastening sealing strips placed in the underground trench having at least the slurry filler material for stabilizing the walls of the underground trench, said method comprising the steps of:

(a) lowering sealing strips lengthwise and vertically into the underground trench to locate adjacent edges of adjacent strips in positions to join the edges of the adjacent strips to one another;

(b) placing housing means on both sides of the sealing strips adjacent at least one of the adjacent edges of the adjacent strips to be joined;

(c) pumping out filler material from within said housing means; and (d) joining the edges of at least two adjacent strips.

4. Method according to claim 3, wherein said pumping is done sufficiently rapidly to create a sudden underpressure inside said housing for substantially emptying said housing.

5. Method according to claim 4, wherein said pumping is done from substantially above the trench with at least one suction line.

6. Method according to claim 5, wherein said at least one suction line is placed less than one meter into the filler material, and wherein said filler material comprises a bentonite slurry.

7. Method according to claim 3, wherein said joining of the adjacent strips comprises welding the areas of the adjacent strips in the vicinity of the edges to form a welded seam.

8. Method according to claim 7, including tensioning the edges of the adjacent strips and welding from a lower portion of the adjacent strips to an upper portion to produce at least one weld seam between the adjacent strips being welded.

9. Method according to claim 7, including testing said at least one welded seam.

10. Apparatus for fastening sealing strips in an underground trench with first and second walls and having at least a filler material for stabilizing the walls of the underground trench comprising:

(a) sealing strips for being lowered by lowering apparatus lengthwise and vertically into the underground trench to locate the edges of adjacent strips in positions to join the edges of the adjacent strips to one another;

(b) housing means for being positioned on both sides of the sealing strips and adjacent at least one of the adjacent edges of the adjacent strips to be joined;

(c) pumping means for pumping out said filler material from within said housing means; and (d) joining means for joining the edges of at least two adjacent strips wherein said housing means comprises two housing parts, one for being disposed on one side of the strips and the other for being disposed on another side of the strips;

said housing means having two halves for being placed on each side of one of said at least one of the adjacent edges of the adjacent strips to be joined.

11. Apparatus for fastening sealing strips in an underground trench with first and second walls and having at least a filler material for stabilizing the walls of the underground trench comprising:

sealing strips for being lowered by lowering apparatus lengthwise and vertically into the underground trench to locate the edges of adjacent strips in positions to join the edges of the adjacent strips to one another;

housing means for being positioned on both sides of the sealing strips and adjacent at least one of the adjacent edges of the adjacent strips to be joined;

pumping means for pumping out said filler material from within said housing means; and joining means for joining the edges of at least two adjacent strips wherein said housing means comprises two housing parts, one for being disposed on one side of the strips and the other for being disposed on another side of the strips;

said housing means having two halves for being placed on each side of one of said at least one of the adjacent edges of the adjacent strips to be joined; and said housing means simultaneously forming a bulkhead closing the trench in the vertical direction, is made up of individual segments in the vertical direction, has a guide for centering the strip edges, and forms a component of the lowering apparatus for the strips.

12. Apparatus according to claim 11, wherein the housing parts are equipped on their end with inflatable hoses.

13. Apparatus according to claim 12, wherein the hoses are located on both sides of the strip.

14. Apparatus according to claim 13, wherein the hoses have diameters, the sum of which is greater than the distance between first and second walls of the trench.

15. Apparatus according to one or more of the claims 12 to 14, wherein the hoses of housing segments can be coupled together, and at least one hose end projects out from the corresponding housing segment, and the coupling pieces have an outside diameter which is less than the inside diameter of the hose.

16. Apparatus according to one or more of claims 12 to 14, wherein the hoses have at least a rubber coating.

17. Apparatus according to claim 15, wherein the hose segments are bolted to one another.

18. Apparatus according to one or more of claims 11 to 14, wherein the hose segments are equipped with electromagnets.

19. Apparatus according to claim 18, wherein said electromagnets can be activated and controlled individually.

20. Apparatus according to one or more of the claims 11 to 14, wherein housings are self-centering.

21. Apparatus according to claim 20, wherein side walls of the housings are guided into one another.

22. Apparatus according to one or more of claims 11 to 14, wherein the sealing strips are guided with webs in the housings.

23. Apparatus according to one or more of claims 11 to 14, wherein the housing parts form part of the lowering apparatus for the sealing strips.

24. Apparatus according to claim 23, wherein the housing parts form the side walls of the lowering apparatus.

25. Apparatus according to one or more of the claims 11 to 14, characterized by two housing parts, with floors, which housing parts can be inserted before the insertion of the sealing strips.

26. Apparatus according to claim 25, characterized by a releasable connection of the housing parts on the lower end, which has a certain amount of play, which is at least equal to the thickness of the strips.

27. Apparatus according to one or more of claims 11 to 14, wherein a sealing strip is comprised of individual sealing strips, which are laid out parallel to the subterranean curtain wall and are welded with their edges overlapping.

28. Apparatus according to claim 27, wherein the laid out and welded sealing strips are held during lowering on the edge away from the trench.

29. Apparatus according to claim 28, wherein a traverse fastened to the lower edge of the seal, which traverse is suspended by at least two traction mechanisms, which can be controlled independently of one another and jointly with one another.

30. Apparatus according to claim 29, characterized by additional traction mechanisms, whose traction direction runs diagonally to that of the first traction mechanism, and which can be moved independently of the first traction mechanism.

31. Apparatus according to claim 30, further including a housing, which holds the ends of the seal and has closable openings.

32. Apparatus according to claim 31, further including the housing has at least one hose at the openings.

33. Apparatus according to claim 32, characterized by a fluid charge for the hose.

34. Apparatus according to claim 33, further including a pump for the housing.

35. Apparatus according to claim 34, further including a welding platform.

36. Apparatus according to claim 35, further including tension rods.

37. Apparatus according to claim 36, further including the welding platform has recesses for the tension rods.

* * * * *

UNITED STATES PATENT AND TRADEMARK OFFICE

CERTIFICATE OF CORRECTION

PATENT NO. : 4,900,195

DATED : February 13, 1990

INVENTOR(S) : Aloys SCHLUTTER, et al.

It is certified that error appears in the above-identified patent and that said Letters Patent is hereby corrected as shown below:

In column 1, line 9, after "subterranean" delete "an".
In column 1, line 13, after "Subterranean" delete "an".
In column 8, line 15, delete "Join", and insert --join--.
In column 12, line 20, delete "tee", and insert --the--.
In column 12, line 26, delete "55", and insert --155--.
In column 13, line 68, delete "2 mm", and insert --2 m--.
In column 16, line 5, after "130", delete "1".

Signed and Sealed this

Nineteenth Day of February, 1991

*Attest:*

HARRY F. MANBECK, JR.

*Attesting Officer*

*Commissioner of Patents and Trademarks*